US012246215B2

(12) United States Patent
Lin

(10) Patent No.: US 12,246,215 B2
(45) Date of Patent: Mar. 11, 2025

(54) GAMING EXERCISE BIKE

(71) Applicant: XIAMEN GOOD UNITED INDUSTRY CO., LTD., Xiamen (CN)

(72) Inventor: Shih-Yuan Lin, Xiamen (CN)

(73) Assignee: XIAMEN GOOD UNITED INDUSTRY CO., LTD., Xiamen (CN)

( * ) Notice: Subject to any disclaimer, the term of this patent is extended or adjusted under 35 U.S.C. 154(b) by 178 days.

(21) Appl. No.: 18/142,038

(22) Filed: May 2, 2023

(65) Prior Publication Data

US 2024/0366997 A1 Nov. 7, 2024

(51) Int. Cl.
*A63B 22/06* (2006.01)

(52) U.S. Cl.
CPC .... *A63B 22/0605* (2013.01); *A63B 2225/093* (2013.01); *A63B 2225/685* (2013.01)

(58) Field of Classification Search
CPC ..... B62K 21/12; B60L 2200/12; B60Y 2200/132; B60Y 2200/134; G05D 2109/13; A63B 21/225; A63B 22/0605; A63B 22/0046; A63B 22/06; A63B 225/093; A63B 225/685; A63B 225/09; A63B 23/0476; A63B 2022/0647; A63B 2022/0652
See application file for complete search history.

(56) References Cited

U.S. PATENT DOCUMENTS 5,400,676 A * 3/1995 Kao ..... B62K 21/20 280/279
11,806,577 B1 * 11/2023 Baudhuin ..... A63B 21/225
2013/0095982 A1 * 4/2013 Chen ..... A63B 69/18 482/71
2021/0197015 A1 * 7/2021 Anderson ..... A63B 21/012
2022/0223254 A1 * 7/2022 Foley ..... A63B 24/0062

FOREIGN PATENT DOCUMENTS

WO WO-2010036275 A1 * 4/2010 ..... A63B 24/0084
WO WO-2021209937 A1 * 10/2021

* cited by examiner

*Primary Examiner* — Megan Anderson
*Assistant Examiner* — Jonathan A Dicuia
(74) *Attorney, Agent, or Firm* — Fei-Hung Yang

(57) ABSTRACT

A gaming exercise bike includes a main body, a driving mechanism and an auxiliary mechanism. The driving mechanism is at a lower end of the main body, the auxiliary mechanism is at a front end of the driving mechanism, and the main body includes a handlebar disc, a main frame disc and a rubber block assembly. The main frame disc is movably installed to a lower end of the handlebar disc, the rubber block assembly is movably installed to an upper end of the main frame disc, and the driving mechanism includes a front handlebar plastic part, a front main frame plastic part and a main frame tube. With the installation of the driving mechanism, the flywheel assembly can provide resistance, reserve mechanical energy for the rotation of the generator, stabilize idle speed, and make gaming and exercising process safer.

6 Claims, 4 Drawing Sheets

GAMING EXERCISE BIKE

BACKGROUND OF THE DISCLOSURE

Technical Field

The present disclosure relates to the field of gaming and exercise bicycles, more particularly relates to a gaming exercise bike.

Description of the Related Art

Riding an exercise bike can exercise leg muscles, improve joint strength and flexibility, and provide good body-building effect. Exercise bike is convenient to use, simple to manufacture, and capable of providing large amount of exercise and good fitness effect to effectively exercise leg muscles.

At present, most gaming exercise bikes having the foregoing similar functions commercially available on the market adopt a spring structure, which leads to the problems of stiff swing, too fast rebound, etc., resulting in poor exercise effect and affecting the exercise effect of users.

In addition, the gaming exercise bike is not convenient to adjust the height of the seat, and a large number of parts need to be disassembled before making the adjustment, thus making the adjustment very troublesome and reducing the effect of the gaming exercise bike.

SUMMARY OF THE DISCLOSURE

In view of the aforementioned problems of the conventional exercise bikes adopting a spring structure that leads to the problems of stiff swing, too fast rebound, etc. and results in a poor exercise effect, it is a primary objective of this disclosure to provide a gaming exercise bike to overcome the problems of the related art.

To achieve the aforementioned and other objectives, this disclosure discloses a gaming exercise bike, which includes a main body, a driving mechanism and an auxiliary mechanism. The driving mechanism is disposed at a lower end of the main body, the auxiliary mechanism is disposed at a front end of the driving mechanism, and the main body includes a handlebar disc, a main frame disc and a rubber block assembly. The main frame disc is movably installed to a lower end of the handlebar disc, and the rubber block assembly is movably installed to an upper end of the main frame disc. The driving mechanism includes a front handlebar plastic part, a front main frame plastic part and a main frame tube, the front handlebar plastic part is movably installed to an outer end of the rubber block assembly, the front main frame plastic part is movably installed to a lower end of the front handlebar plastic part, and the main frame tube is fixedly installed to a lower end of the front main frame plastic part.

Preferably, the driving mechanism further includes a flywheel assembly, a left pedal, a tube plug, a front leg tube, a right pedal, a rear leg tube and an adjustment knob. The flywheel assembly is movably installed to a lower end of the main frame tube, the left pedal is fixedly installed to a lower end of the flywheel assembly, the front handlebar plastic part is provided for protecting internal parts, the front main frame plastic part is provided for connection, the main frame tube is the main frame of the gaming exercise bike, and the flywheel assembly can provide a certain resistance, reserve the mechanical energy for the rotation of the generator and stabilize the idle speed, so as to make the gaming and exercising process more safely.

Preferably, the tube plug is fixedly installed to a lower end of the left pedal, the front leg tube is fixedly installed to a left end of the tube plug, the right pedal is movably installed to the top of the front leg tube, the rear leg tube is fixedly installed to the front of the right pedal, the adjustment knob is movably installed to the top of the rear leg tube, the right pedal is provided to facilitate the users to work out and exercise their leg muscles, and the adjustment knob is provided for users to conveniently adjust the height of the seat according to the height of the users.

Preferably, the auxiliary mechanism includes a seat adjustment tube, a seat, a rear main frame plastic part, a rear handlebar plastic part, a mobile phone holder, a handlebar assembly and a gear shifter. The seat adjustment tube is movably installed to an upper end of the adjustment knob to assist adjusting heights.

Preferably, the seat is fixedly installed to an upper end of the seat adjustment tube, the rear main frame plastic part is movably installed to the right side of the seat, and the rear handlebar plastic part is movably installed to an upper end of the rear main frame plastic part. The use of a rubber structure can make the swing of the product more smoothly and naturally, avoiding the problems of using a spring structure for similar functions which include stiff swing, too fast rebound, etc., and the rear main frame plastic part is provided to facilitate the installation of internal parts.

Preferably, the mobile phone holder is fixedly installed to the top of the rear handlebar plastic part, the handlebar assembly is fixedly installed to two ends of the front of the mobile phone holder, and the gear shifter is fixedly installed to the bottom of the handlebar assembly. In addition to using the pedals to simulate the cycling exercise, the handlebar can be turned to the rear and the forth, or to the left and the right to increase arm exercise, and the gear shifter is provided for easily adjusting the speed of the gaming exercise bike.

Compared with the related art, this disclosure has the following beneficial effects:

1. With the installation of the driving mechanism, the flywheel assembly can provide resistance, reserve mechanical energy for the rotation of the generator, stabilize idle speed, and make gaming and exercising process safer, and the adjustment knob facilitates the adjustment of the seat according to the height of the user, thus making the adjustment more convenient and improving the safety of the gaming exercise bike.

2. With the use of the auxiliary mechanism, the use of a rubber structure can make the swing of the product more smoothly and naturally, avoiding the problems of using a spring structure for similar functions which include stiff swing, too fast rebound, etc. In addition to using the pedals to simulate the cycling exercise, the handlebar can be turned to the rear and the forth, or to the left and the right to increase arm exercise, and the convenience of use of the gaming exercise bike.

3. With the installation of the main body, the rubber block assembly made of a highly elastic polymer material takes the advantage of its high elasticity and resilience, in conjunction with the use of a product structure having a thinner middle and two thicker ends, so that the product can swing in different directions, which improves the practicality of the gaming exercise bike.

DESCRIPTION OF THE PREFERRED EMBODIMENTS

The technical characteristics of this disclosure will become apparent in the following detailed description of the preferred embodiments with reference to the accompanying drawings. It is noteworthy that the drawings used in the specification and subject matters of this disclosure are intended for illustrating the technical characteristics of this disclosure, but not necessarily to be drawn according to actual proportion and precise configuration. Therefore, the scope of this disclosure should not be limited to the proportion and configuration of the drawings.

Figure 1:
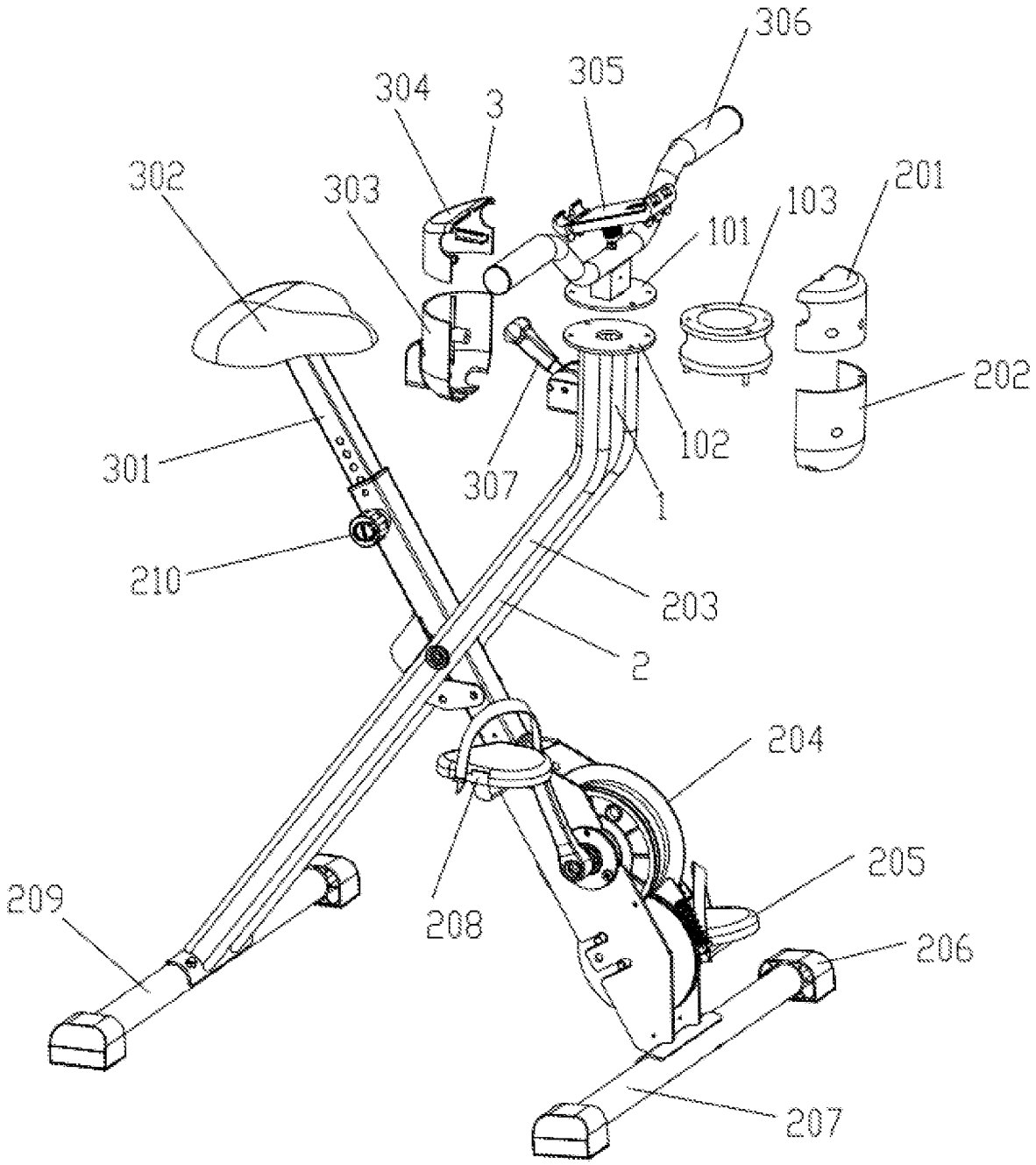
FIG. 1 is a perspective view of the structure of this disclosure.
Figure 2:
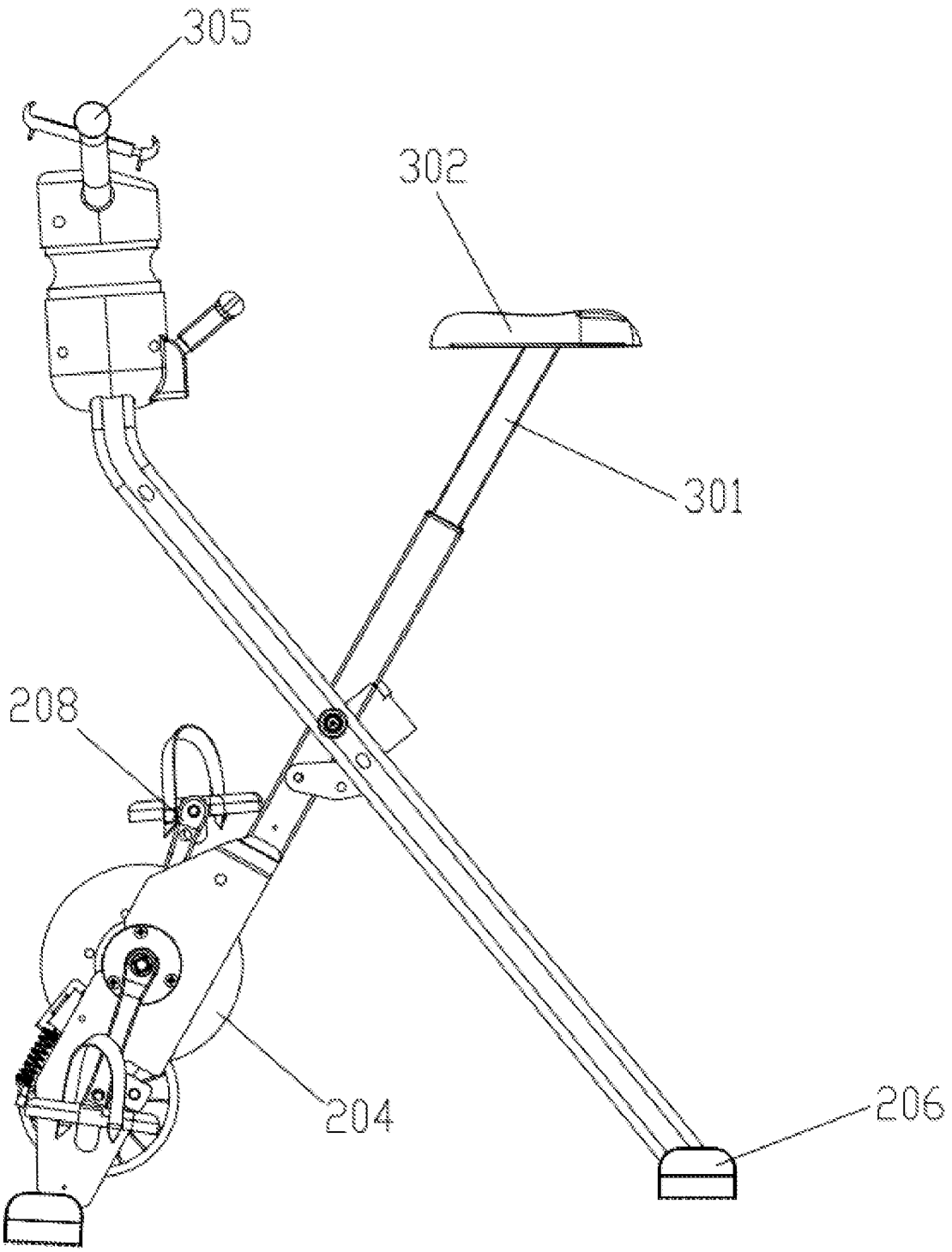
FIG. 2 is a cross-sectional view of the structure of this disclosure.
Figure 3:
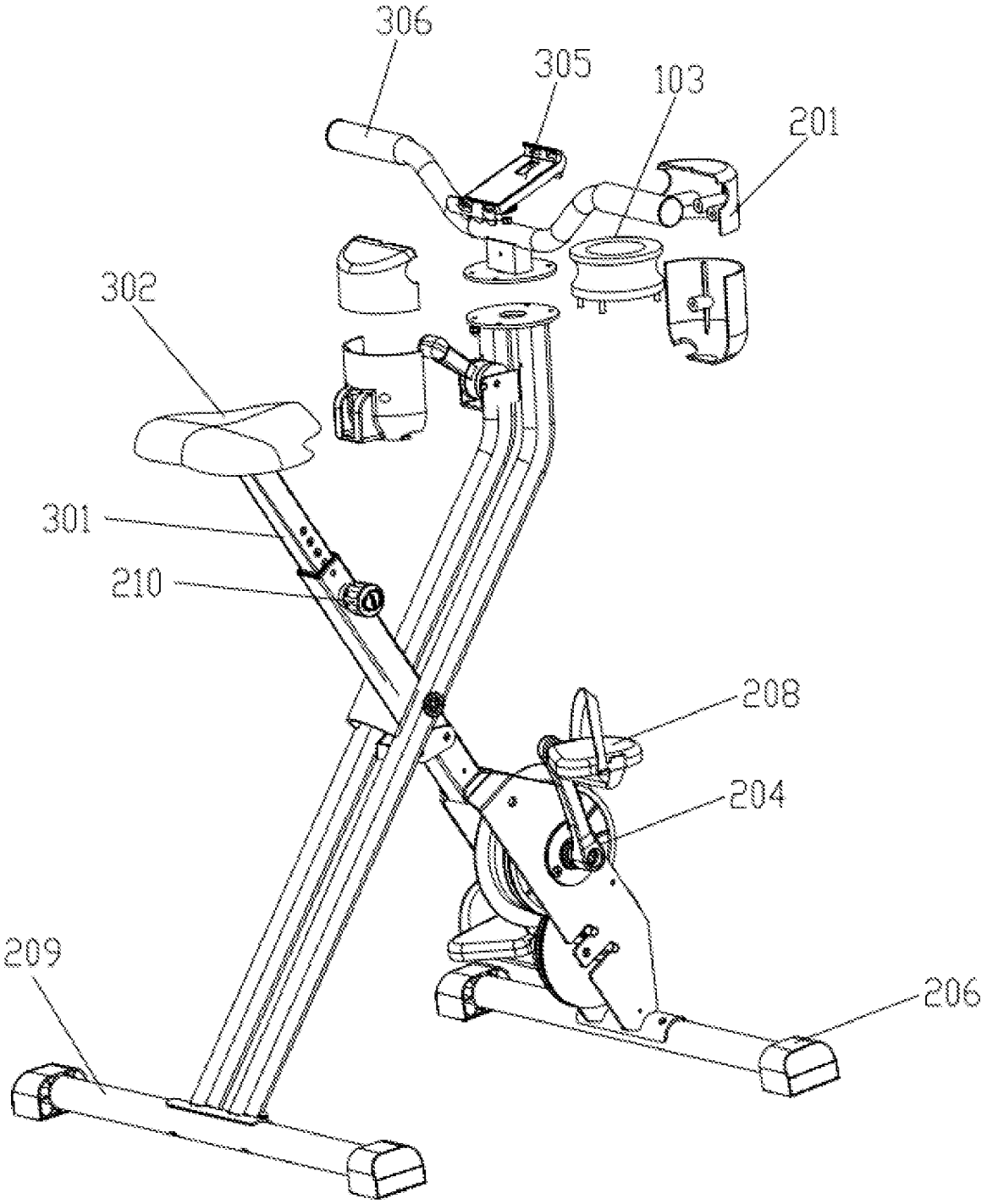
FIG. 3 is a perspective view of the detailed structure of this disclosure.
Figure 4:
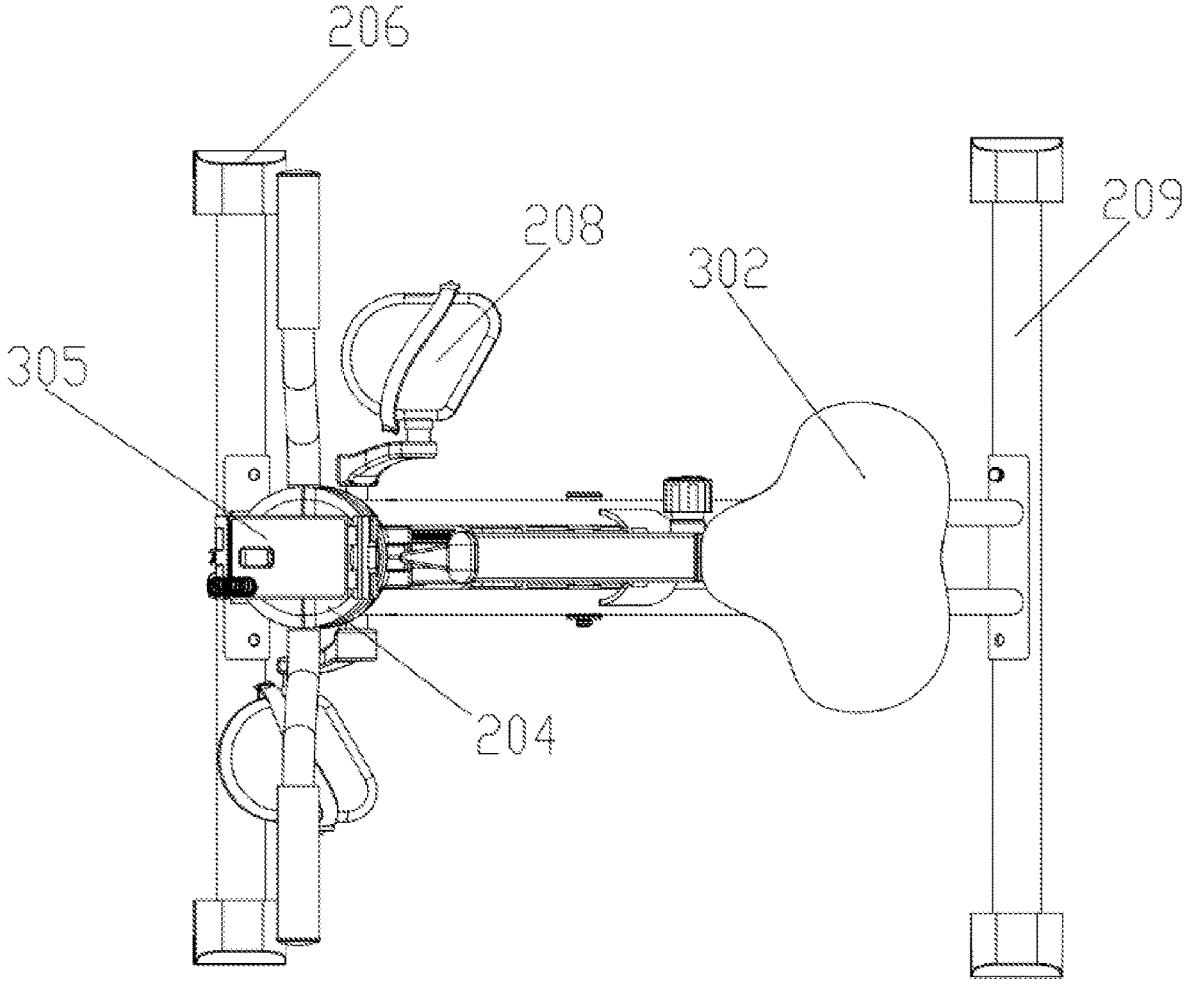
FIG. 4 is a top cross-sectional view of the structure of this disclosure.

With reference to FIGS. 1 to 4 for a gaming exercise bike of this disclosure, the gaming exercise bike includes a main body 1, a driving mechanism 2 and an auxiliary mechanism 3, the driving mechanism 2 is disposed at a lower end of the main body 1, and the auxiliary mechanism 3 is disposed at a front end of the driving mechanism 2. The main body 1 includes a handlebar disc 101, a main frame disc 102 and a rubber block assembly 103, the main frame disc 102 is movably installed to a lower end of the handlebar disc 101, and the rubber block assembly 103 is movably installed to an upper end of the main frame disc 102. The driving mechanism 2 includes a front handlebar plastic part 201, a front main frame plastic part 202 and a main frame tube 203, the front handlebar plastic part 201 is movably installed to an outer end of the rubber block assembly 103, the front main frame plastic part 202 is movably installed to a lower end of the front handlebar plastic part 201, and the main frame tube 203 is fixedly installed to a lower end of the front main frame plastic part 202.

The driving mechanism 2 further includes a flywheel assembly 204, a left pedal 205, a tube plug 206, a front leg tube 207, a right pedal 208, a rear leg tube 209 and an adjustment knob 210, the flywheel assembly 204 is movably installed to a lower end of the main frame tube 203, the left pedal 205 is fixedly installed to a lower end of the flywheel assembly 204, the tube plug 206 is fixedly installed to a lower end of the left pedal 205, the front leg tube 207 is fixedly installed to a left end of the tube plug 206, the right pedal 208 is movably installed to the top of the front leg tube 207, the rear leg tube 209 is fixedly installed to the front of the right pedal 208, and the adjustment knob 210 is movably installed to the top of the rear leg tube 209. In installation, the front main frame plastic part 202 is used for installation, and users press the adjustment knob 210, and adjust the height of the seat 302 by a seat adjustment tube 301.

The auxiliary mechanism 3 includes a seat adjustment tube 301, a seat 302, 303, a rear handlebar plastic part 304, a mobile phone holder 305, a handlebar assembly 306 and a gear shifter 307. The seat adjustment tube 301 is movably installed to an upper end of the adjustment knob 210, the seat 302 is fixedly installed to an upper end of the seat adjustment tube 301, the rear main frame plastic part 303 is movably installed to the right side of the seat 302, the rear handlebar plastic part 304 is movably installed to an upper end of the rear main frame plastic part 303, the mobile phone holder 305 is fixedly installed to the top of the rear handlebar plastic part 304, the handlebar assembly 306 is fixedly installed to two ends of the front of the mobile phone holder 305, and the gear shifter 307 is fixedly installed to the bottom of the handlebar assembly 306. After completing the adjustment, the user sits on the seat 302, and puts both legs on the right pedal 208 and left pedal 205 respectively. The user can use the gear shifter 307 to change speeds, step on the left pedal 205 and the right pedal 208 with force to drive the flywheel assembly 204 to rotate, or put a mobile phone on the mobile phone holder 305 and turn the handlebar to play mobile games.

In the principle of operation, the front main frame plastic part 202 is provided for the installation, and a user can press the adjustment knob 210, adjust the height of the seat 302 by the seat adjustment tube 301. After completing the adjustment, the user can sit on the seat 302, put both legs on the right pedal 208 and the left pedal 205 respectively, use the gear shifter 307 to adjust speed, step on the left pedal 205 and the right pedal 208 with force to drive the flywheel assembly 204 to rotate, put a mobile phone on the mobile phone holder 305, and turn the handlebar to play mobile games.

What is claimed is:

1. A gaming exercise bike, comprising a main body, a driving mechanism, and an auxiliary mechanism, characterized in that:

the driving mechanism is disposed at a lower end of the main body, the auxiliary mechanism is disposed at a front end of the driving mechanism; the main body comprises a handlebar disc, a main frame disc and a rubber block assembly, the main frame disc is movably installed to a lower end of the handlebar disc, the rubber block assembly is movably installed to an upper end of the main frame disc; the driving mechanism comprises a front handlebar plastic part, a front main frame plastic part and a main frame tube, the front handlebar plastic part is movably installed to an outer end of the rubber block assembly, the front main frame plastic part is movably installed to a lower end of the front handlebar plastic part, and the main frame tube is fixedly installed to a lower end of the front main frame plastic part.

2. The gaming exercise bike according to claim 1, wherein the driving mechanism further comprises a flywheel assembly, a left pedal, a tube plug, a front leg tube, a right pedal, a rear leg tube, and an adjustment knob, the flywheel assembly is movably installed to a lower end of the main frame tube, and the left pedal is fixedly installed to a lower end of the flywheel assembly.

3. The gaming exercise bike according to claim 2, wherein the tube plug is fixedly installed to a lower end of the left pedal, the front leg tube is fixedly installed to a left end of the tube plug, the right pedal is movably installed to top of the front leg tube, the rear leg tube is fixedly installed to front of the right pedal, and the adjustment knob is movably installed to top of the rear leg tube.

4. The gaming exercise bike according to claim 3, wherein the auxiliary mechanism comprises a seat adjustment tube, a seat, a rear main frame plastic part, a rear handlebar plastic part, a mobile phone holder, a handlebar assembly and a gear shifter, and the seat adjustment tube is movably installed to an upper end of the adjustment knob.

5. The gaming exercise bike according to claim 4, wherein the seat is fixedly installed to an upper end of the seat adjustment tube, the rear main frame plastic part is movably installed to right side of the seat, and the rear handlebar plastic part is movably installed to an upper end of the rear main frame plastic part.

6. The gaming exercise bike according to claim 5, wherein the mobile phone holder is fixedly installed to top of the rear handlebar plastic part, the handlebar assembly is fixedly installed to two ends of front of the mobile phone holder, and the gear shifter is fixedly installed to bottom of the handlebar assembly.

* * * * *